US006938778B2

(12) United States Patent
Allaei

(10) Patent No.: US 6,938,778 B2
(45) Date of Patent: Sep. 6, 2005

(54) SMART SCREENING MACHINE

(75) Inventor: Daryoush Allaei, Minnetonka, MN (US)

(73) Assignee: Quality Research, Development & Consulting, Inc., Chaska, MN (US)

( * ) Notice: Subject to any disclaimer, the term of this patent is extended or adjusted under 35 U.S.C. 154(b) by 0 days.

(21) Appl. No.: 10/321,083

(22) Filed: Dec. 17, 2002

(65) Prior Publication Data

US 2003/0085159 A1 May 8, 2003

Related U.S. Application Data

(63) Continuation of application No. 09/792,778, filed on Feb. 23, 2001, now Pat. No. 6,543,620.

(51) Int. Cl.[7] ..... B07B 1/42

(52) U.S. Cl. ..... 209/365.1; 209/365.4; 209/379; 310/325

(58) Field of Search ..... 209/366, 365.1, 209/365.4, 309, 379; 310/338, 339, 328, 320, 321, 325

(56) References Cited

U.S. PATENT DOCUMENTS

| | | | | |
|---|---|---|---|---|
| 4,816,144 A | | 3/1989 | Monteith | |
| 5,143,222 A | | 9/1992 | Monteith | |
| 5,386,169 A | | 1/1995 | Dubruque | |
| 5,542,548 A | | 8/1996 | Senapati | |
| 5,653,346 A | | 8/1997 | Frei et al. | |
| 5,799,799 A | * | 9/1998 | Alamzad et al. | 209/365.1 |
| 5,915,566 A | * | 6/1999 | Senapati | 209/365.1 |
| 6,079,569 A | * | 6/2000 | Monteith | 209/364 |

FOREIGN PATENT DOCUMENTS

| | | |
|---|---|---|
| DE | 94 22 091 | 2/1998 |
| WO | WO 92 12807 | 8/1992 |
| WO | WO 99 16558 | 4/1999 |

* cited by examiner

*Primary Examiner*—Donald P. Walsh
*Assistant Examiner*—Matthew J. Kohner
(74) *Attorney, Agent, or Firm*—Leffert Jay & Polglaze, P.A.

(57) ABSTRACT

A screening machine having a base is provided. A screen is coupled to the base to separate material by size. The screening machine includes a vibration motor having piezoelectric elements and a vibration amplifier located between the piezoelectric elements and the screen. One or more of the piezoelectric elements can be used as sensors to provide feedback for operation control.

23 Claims, 6 Drawing Sheets

SMART SCREENING MACHINE

CROSS REFERENCE TO RELATED APPLICATIONS

This Application is a Divisional of U.S. application Ser. No. 09/792,778 filed Feb. 23, 2001 now U.S. Pat. No. 6,543,620.

TECHNICAL FIELD

The present invention relates generally to the field of physical separation of materials and, in particular, to vibrating screens.

BACKGROUND

Vibrating screens are used by a number of industries, e.g., mining, food processing, sand-and-gravel, etc., to separate a fine portion of a heterogeneous substance from a coarse portion. For example, the mining industry (e.g., taconite processing) uses vibrating screens after the ore is crushed to separate fine ore from coarse ore. Typical screening processes involve placing a heterogeneous substance that comprises fine and coarse portions atop a screen. The screen is then vibrated so that the fine portion passes through the screen and the coarse portion stays atop the screen.

Typically, an electric motor having a rotating unbalance vibrates the screen. Electrical unbalance motors are usually heavy and bulky and normally require considerable maintenance and a heavy support structure. Another disadvantage is that such a configuration normally involves several moving parts, many of which are heavy and bulky, and a number of bearings. These moving parts and bearings require considerable maintenance and generate heat and excessive audible noise. Moreover, a substantial portion of the energy output of the electric motor typically goes into the useless elastic deformation of the heavy support structure and the generation of audible noise and heat.

To put this into perspective, the use of the above-type of vibrating screens during taconite processing will be used by way of example. Many of the screening operations used during taconite processing involve a motor vibrating a load that is at least 17 times the load of taconite to be screened. Moreover, the noise generated by the vibrating screens used in taconite processing may result in work environment safety issues. The taconite industry has identified vibrating screens as being responsible for substantial maintenance costs and production losses.

For the reasons stated above, and for other reasons stated below which will become apparent to those skilled in the art upon reading and understanding the present specification, there is a need in the art for vibrating screens that are smaller and lighter, that have fewer moving parts and fewer bearings, and that consequently are less noisy, require less maintenance, have reduced downtimes, and are more energy efficient than conventional vibrating screens.

SUMMARY

The above-mentioned problems with conventional vibrating screens and other problems are addressed by embodiments of the present invention and will be understood by reading and studying the following specification. Embodiments of the present invention provide a screening machine.

More particularly, in one embodiment, a screening machine having a base is provided. A screen is coupled to the base to separate material by size. The screening machine includes a vibration motor having piezoelectric elements and a vibration amplifier located between the piezoelectric elements and the screen.

Another embodiment provides a screening machine with a frame and a mesh enclosed within and attached to the frame. A motion amplifier is substantially rigidly attached to the frame and not in direct contact with the mesh. A piezoelectric transducer is substantially rigidly attached in direct contact with the motion amplifier to impart a vibratory motion to the motion amplifier. A piezoelectric sensor is also substantially rigidly attached in direct contact with the motion amplifier.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical mechanical and electrical changes may be made without departing from the spirit and scope of the present invention. The following detailed description is, therefore, not to be taken in a limiting sense.

Embodiments of the present invention replace the electrical motor and rotating unbalance used with conventional vibrating screens with a combination of transducers and motion amplifiers and thus the concomitant heavy support structure and numerous moving parts and bearings. The transducers can be piezoelectric patches, discrete piezoelectric components, or electromagnetic shakers. In embodiments of the present invention, these transducers are attached to a screen and are used to vibrate the screen.

Figure 1:
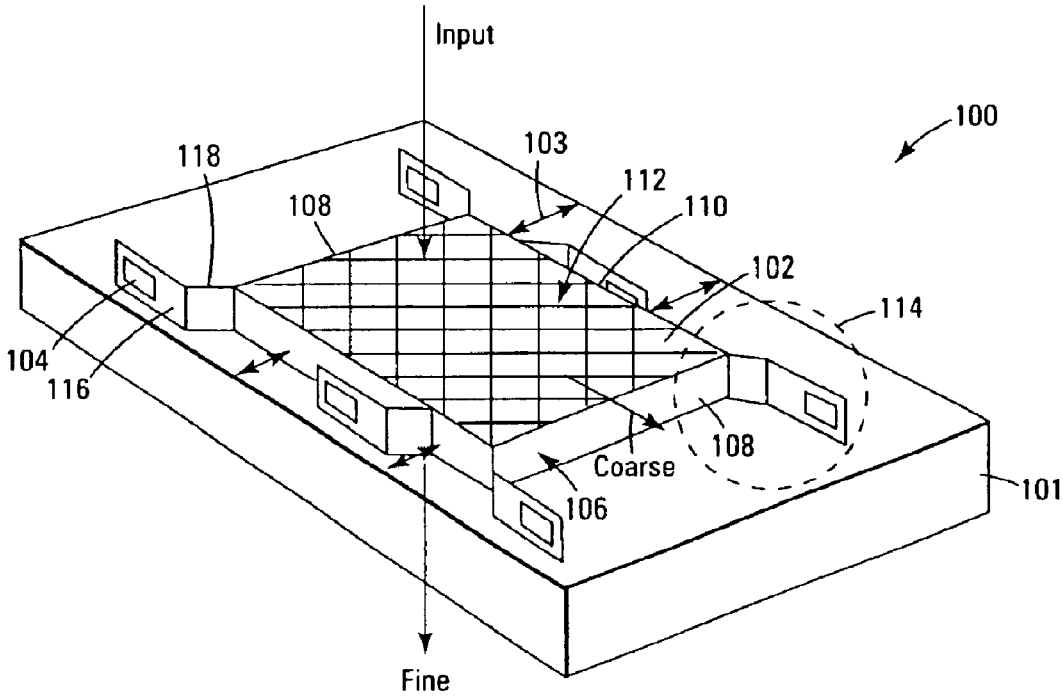
FIG. 1 is a top view of an embodiment of the screening machine of the present invention.

A first embodiment of the present invention is demonstrated by the simplified top view of screen machine 100 in FIG. 1. Screen machine 100 includes a base 101 and screen 102. Transducers 104 are substantially rigidly attached to screen 102. Screen 102 and transducers 104 are discussed in more detail below. The screen is used to separate fine material from course material. The screen is mounted to the base using spring-type mountings 103. The spring-type mountings 103 allow the screen to be moved independently of the mounting base.

Screen 102 includes frame 106 having two opposing boundaries 108 and two opposing boundaries 110 that are perpendicular to boundaries 108. Boundaries 108 and 110 can be solid or hollowed-out solids. Boundaries 108 and 110 have a cross-sectional shape that can be circular, rectangular, square, angular, or the like. Boundaries 108 and 110 can be fabricated from steel, plastic, ceramic, aluminum, or the like. Boundaries 108 can be attached to boundaries 110 by welding, gluing, bolting, using cap screws, or the like. Alternatively, frame 104 can be formed as a single component by casting or the like, with boundaries 108 and 110 being integral with each other. It will be appreciated by those skilled in the art that that FIG. 1 has been simplified to focus on the present invention and numerous features are not illustrated. For example, material input and output mechanisms, and control components are not illustrated in FIG. 1.

Screen 102 includes mesh 112 that is enclosed within frame 106. Mesh 112 can be fabricated from steel, plastic, ceramic, aluminum, urethane, rubber, or the like. Mesh 112 can be attached to frame 106 by welding, gluing, bolting, using cap screws, or the like. The mesh size varies according to the size of material that is to be screened out.

In one embodiment, transducers 104 are of a piezoelectric material, such as a formulation of lead, magnesium, and niobate (PMN), a formulation of lead, zirconate, and titanate (PZT), or the like. In another embodiment, transducers 104 are electromagnetic shakers or unbalanced motors. In another embodiment, transducers 104 include integral transducer and sensor portions, e.g., both are piezoelectric materials. In another embodiment, transducers 104 include separate, adjacent transducer and sensor portions, e.g., the transducer portion is an electromagnetic shaker and the sensor portion is a piezoelectric material, both are piezoelectric materials, or the like.

When an alternating voltage is applied to a piezoelectric material, such as transducer 104, the piezoelectric material alternately expands and contracts. When an alternately expanding and contracting piezoelectric material is attached to an object, such as screen 102, the alternating expansions and contractions cause the object to vibrate. Conversely, when a vibrating object, such as screen 102, exerts an alternating force on a piezoelectric material, the piezoelectric material alternately expands and contracts, and the piezoelectric material produces an alternating voltage that is indicative of the vibration. In this manner, the piezoelectric material can be used as a sensor. These facts can be used to construct transducers having sensing capabilities. For example, a transducer can include adjacent piezoelectric portions, where one portion has leads used as an input for accepting an alternating voltage and the other portion has leads used as an output for outputting voltages indicative of vibrations.

In another embodiment, where transducer 104 is an electromagnetic shaker attached to screen 102, the electromagnetic shaker imparts a vibratory motion to the screen 102.

Figure 2:
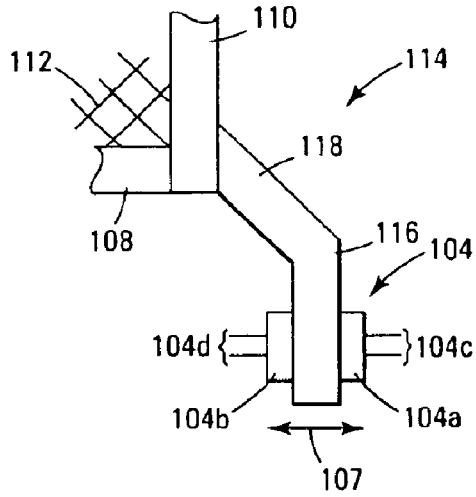
FIG. 2 is an enlarged view of a portion of FIG. 1.

FIG. 2 is an enlarged view of encircled region 114 of screening machine 100. FIG. 2 demonstrates that one embodiment of transducer 104 includes patches 104*a* and 104*b*, each of PMN, PZT, or the like. In another embodiment at least one of patches 104*a* and 104*b* is an electromagnetic shaker. Patches 104*a* and 104*b* are substantially rigidly attached, as shown, to motion amplifier 116 by bolting, screwing, gluing, or the like and sandwich motion amplifier 116 between them. Hereinafter "substantially rigidly attached" will be referred to as "attached" and will include these methods of attachment and others recognized as suitable equivalents by those skilled in the art. The transducers apply lateral forces to the screen as shown by arrow 107. These forces may be amplified, as described below, to provide vibration to the screen.

In one embodiment, patches 104*a* and 104*b* respectively include electrical leads 104*c* and 104*d*. In one embodiment, leads 104*c* and 104*d* are used to input an alternating voltage that causes the respective patch to impart a vibratory motion to motion amplifier 116. In another embodiment, one of leads 104*c* and 104*d* is used to output a voltage that is indicative of the vibratory motion of motion amplifier 116 and thus the corresponding patch acts as a sensor.

Piezoelectric and electromagnetic shaker construction and operation are well known to those in the art. A detailed discussion, therefore, of specific constructions and operation is not provided herein. It will be understood, with the benefit of the present description, that transducers 104 are electrically controlled to provide physical movement. As described below, using multiple transducer elements in unison and/or placing an amplifier between the transducer elements and the screen can enhance the physical movement.

Frame 106 can include an optional extension 118 adjacent each of its corners. A motion amplifier 116 is attached to frame 106 at each extension 118. In other embodiments, frame 106 includes extensions 118 at locations intermediate to the corners of frame 106, as shown in FIG. 1. In these embodiments, a motion amplifier 116 can be attached to the frame at each of these extensions 118, with each motion amplifier having a transducer(s) 104 attached thereto, as shown in FIG. 1. Motion amplifier 116 can be steel, aluminum, plastic, a composite, a fiber reinforced laminate, or the like.

In operation, transducer 104 imparts a vibratory action to motion amplifier 116 (arrow 107). Motion amplifier 116 amplifies the vibration (i.e., the displacement and the acceleration of the vibration) and transmits the amplified vibration to frame 106, thus causing screen 102 to vibrate. The amplification increases as the distance between transducer 104 and the location of attachment of motion amplifier 116 to frame 106 increases, e.g., the distance between transducer 104 and extension 118.

In another embodiment, transducer 104 imparts a vibratory action to motion amplifier 116 at substantially the resonant frequency of motion amplifier 116, in which case motion amplifier 116 may be termed a resonator. At substantially resonant conditions, motion amplifier 116 not only amplifies the displacement output of the transducer but also the energy output.

In another embodiment transducers 104 are used to divert energy from particular regions of screen 102 and to focus the energy at other regions where it is more useful, thus making the system more efficient. The focused energy can be used directly or after amplification to vibrate screen 102. Detailed descriptions of how energy can be diverted from one region and focused at another region are given in U.S. Pat. No. 6,116,389 entitled APPARATUS AND METHOD FOR CONFINEMENT AND DAMPING OF VIBRATION ENERGY issued on Sep. 12, 2000 and U.S. Pat. No. 6,032,552 entitled VIBRATION CONTROL BY CONFINEMENT OF VIBRATION ENERGY issued on Mar. 7, 2000, which are incorporated herein by reference, and in pending U.S. application Ser. No. 09/721,102 entitled ACTIVE VIBRATION CONTROL BY CONFINEMENT filed on Nov. 22, 2000, which is incorporated herein by reference.

Figure 3A:
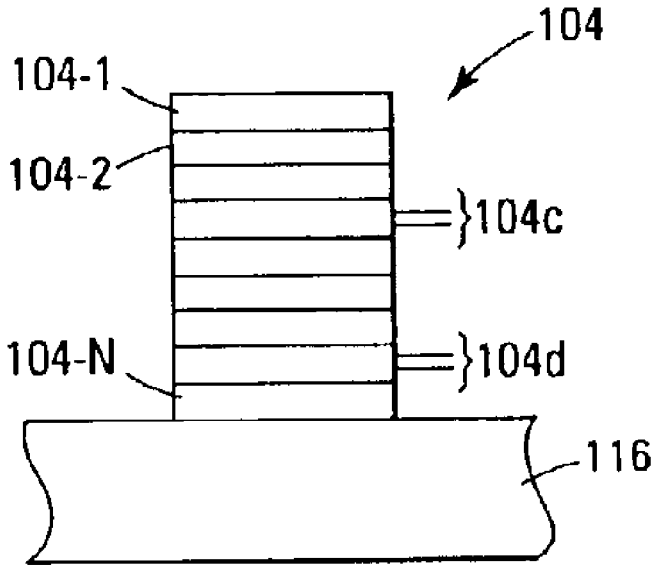
FIG. 3*a* is a side view of an embodiment of a transducer for vibrating a screen.

FIG. 3*a* illustrates a stacked embodiment of transducer 104 attached to an amplifier 116. In this embodiment, transducer 104 comprises piezoelectric layers 104-1 through 104-N stacked one atop the other. Each of piezoelectric layers 104-1 through 104-N is a formulation of lead, magnesium, and niobate (PMN), a formulation of lead, zirconate, and titanate (PZT), or the like. In one embodiment, piezoelectric layers 104-1 through 104-N are electrically interconnected in parallel. Stacking of layers 104-1 through 104-N amplifies the vibration by multiplying the force or the vibration displacement by the number of layers. In one embodiment, one or more of layers 104-1 through 104-N can be used as a sensor. That is, piezoelectric elements can be used to provide motion in response to an applied voltage, or provide a voltage in response to physical changes.

Figure 3B:
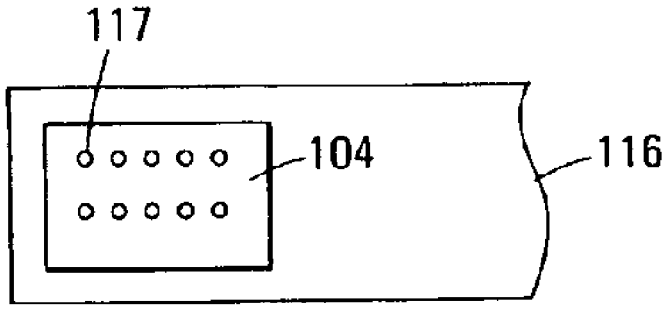
FIG. 3*b* illustrates a transducer having an array of discrete components.

FIG. 3*b* is a side view of a transducer 104 attached to motion amplifier 116. The transducer includes an array of discrete piezoelectric elements 117. Each element provides physical movement to the amplifier, or directly to the screen, in response to applied voltages. Again, one or more of the elements can be coupled as a sensor.

Figure 4A:
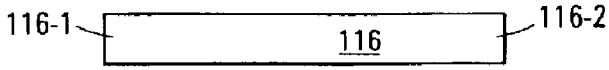
FIGS. 4*a* through 4*d* are side-view illustrations of different embodiments of a motion amplifier for amplifying vibrations imparted to a screen by a transducer.
Figure 4B:
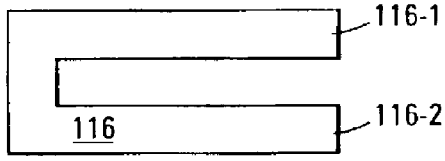
Figure 4C:
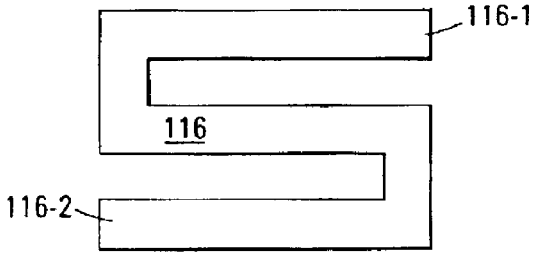
Figure 4D:
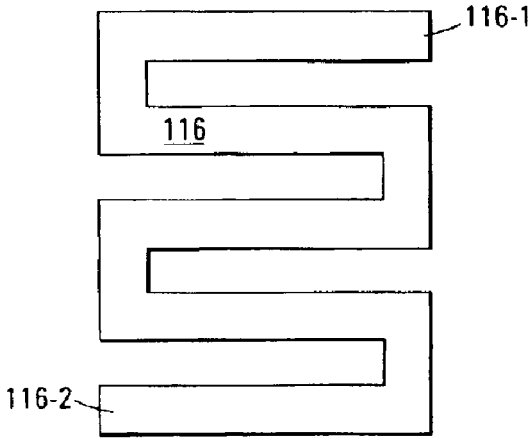

FIGS. 4*a* through 4*d* illustrate side views of different embodiments of motion amplifier 116. FIG. 4*a* illustrates a straight motion amplifier 116. FIG. 4*b* illustrates a C-shaped motion amplifier 116, and FIG. 4*c* illustrates an S-shaped motion amplifier 116. It will be appreciated by those of ordinary skill in the art that the embodiments of motion amplifier 116 illustrated in FIGS. 4*a* through 4*c* can be combined in various ways to form other embodiments of motion amplifier 116. For example, FIG. 4*d* illustrates an embodiment of motion amplifier 116 that includes several C-shaped motion amplifiers linked together.

In the embodiments of motion amplifier 116 illustrated in FIGS. 4*a* through 4*d*, transducer 104 is attached to one of end regions 116-1 or 116-2, and motion amplifier 116 is attached to frame 106 at the other of end regions 116-1 or 116-2. In operation, transducer 104 imparts a vibratory motion to one of end regions 116-1 or 116-2. Motion amplifier 116 amplifies the vibration between transducer 104 and the other of end regions 116-1 or 116-2, where the vibration is imparted to frame 106.

Figure 5A:
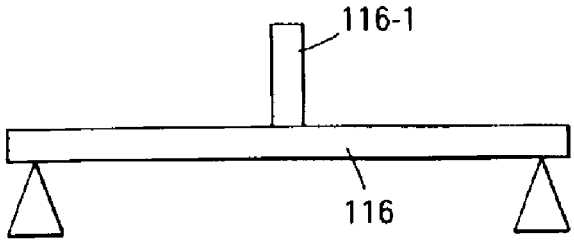
FIGS. 5*a* and 5*b* are side view illustrations of other embodiments of motion amplifiers for amplifying vibrations imparted to a screen by a transducer.
Figure 5B:
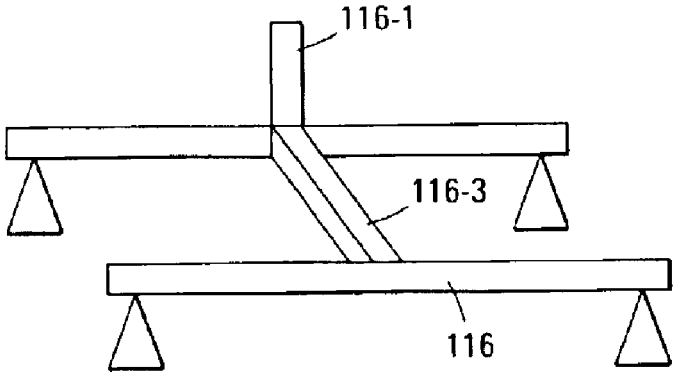

The embodiments of motion amplifier 116 demonstrated in FIGS. 4*a* through 4*d* are based on a basic cantilever beam where the transducer is attached to the free end. However, the size and shape of the motion amplifier can be selected to increase or decrease movement of the screen based on engineering requirements, and the present invention is not limited to any specific size, length, cross-section shape or overall geometric configuration of amplifier. For example, FIG. 5*a* illustrates an embodiment of motion amplifier 116 that comprises a beam that is pinned at both of its ends. FIG. 5*b* illustrates an embodiment of motion amplifier 116 that comprises a pair of beams, each pinned at both of its ends, and a substantially rigid coupler 116-3 that couples the two beams together. In FIG. 5*a*, a transducer 104 is attached to the beam at a location between the end supports, and motion amplifier 116 is attached to frame 106 at region 116-1. In FIG. 5*b*, a transducer 104 can be attached to at least one of the beams at a location between the end supports, and motion amplifier 116 is attached to frame 106 at region 116-1.

Figure 6:
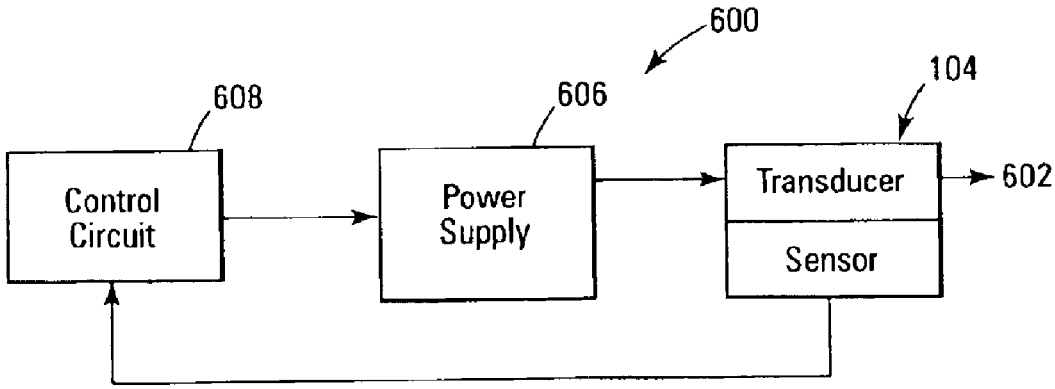
FIG. 6 is a block diagram of an embodiment of a control apparatus for controlling vibrations imparted to a screen by a transducer.

FIG. 6 is a block diagram illustrating control apparatus 600 for controlling vibratory output 602 of transducer 104 and thereby the vibration of screen 102. Power supply 606 is electrically coupled to an input of a transducer portion of transducer 104 and transmits an ac voltage to it. An output of a sensor portion of transducer 104 is electrically coupled to an input of control circuit 608 and transmits a monitoring signal indicative of the vibration of screen 102 to it. An output of control circuit 608 is coupled to an input of power supply 606 and transmits a control signal to it. In one embodiment, the control signal adjusts the voltage amplitude up or down and thereby the amplitude of output 602.

In operation, power supply 606 transmits an alternating voltage to the transducer portion of transducer 104. The alternating voltage causes the transducer portion to produce vibratory output 602 that imparts a vibratory motion to screen 102 via motion amplifier 116. The sensor portion transmits a monitoring signal to control circuit 608 that is indicative of the vibration of screen 102.

In one embodiment, the monitoring signal is indicative of the amplitude of the vibration of screen 102. Control circuit 608 compares the amplitude to a preselected amplitude and transmits a control signal to power supply 606. The control signal adjusts the amplitude of the ac voltage transmitted by power supply 606 to the transducer portion, thereby adjusting the amplitude of the vibration of screen 102. In one embodiment, the preselected amplitude is the amplitude required to maintain the flow of the fine portion of the substance being screened through mesh 112.

Figure 7:
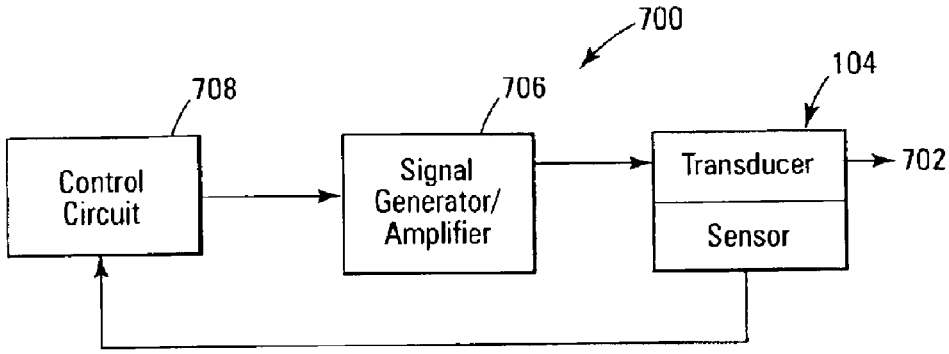
FIG. 7 is a block diagram of another embodiment of a control apparatus for controlling vibrations imparted to a screen by a transducer.

FIG. 7 is a block diagram illustrating another control apparatus 700 for controlling vibratory output 702 of transducer 104 and thereby the vibration of screen 102. Signal-generator/amplifier 706 is electrically coupled an input of a transducer portion of transducer 104 and transmits an ac voltage to it. An output of a sensor portion of transducer 104 is electrically coupled to an input of control circuit 708 and transmits a monitoring signal indicative of the vibration of screen 102 to it. An output of control circuit 708 is coupled to an input of signal-generator/amplifier 706 and transmits a control signal to it.

In operation, signal-generator/amplifier 706 transmits an alternating voltage to the transducer portion of transducer 104. The alternating voltage causes the transducer portion to produce vibratory output 702 that imparts a vibratory motion to screen 102 via motion amplifier 116. The sensor portion transmits a monitoring signal to control circuit 708 that is indicative of the vibration of screen 102.

In one embodiment, the monitoring signal is indicative of the amplitude of the vibration of screen 102. Control circuit 708 compares the amplitude to a preselected amplitude and transmits a control signal to signal-generator/amplifier 706. The control signal adjusts the amplitude of the ac voltage transmitted by signal-generator/amplifier 706 to the transducer portion, thereby adjusting the amplitude of the vibration of screen 102. In one embodiment, the preselected amplitude is the amplitude required to maintain the flow of the fine portion of the substance being screened through mesh 112.

In another embodiment, the monitoring signal is indicative of the frequency of the vibration of screen 102. Control circuit 708 compares the frequency to a preselected frequency and transmits a control signal to signal-generator/amplifier 706. The control signal adjusts the frequency of the ac voltage transmitted by signal-generator/amplifier 706 to the transducer portion, thereby adjusting the frequency of the vibration of screen 102. In one embodiment, the preselected frequency is the frequency required to maintain the flow of the fine portion of the substance being screened through mesh 112.

In another embodiment, the monitoring signal is indicative of the frequency and amplitude of the vibration of screen 102. Control circuit 708 compares the frequency and amplitude to a preselected frequency and amplitude and transmits a control signal to signal-generator/amplifier 706. The control signal adjusts the frequency and amplitude of the ac voltage transmitted by signal-generator/amplifier 706 to the transducer portion, thereby adjusting the frequency and amplitude of the vibration of screen 102. In one embodiment, the preselected frequency and amplitude are the frequency and amplitude required to maintain the flow of the fine portion of the substance being screened through mesh 112.

Figure 8:
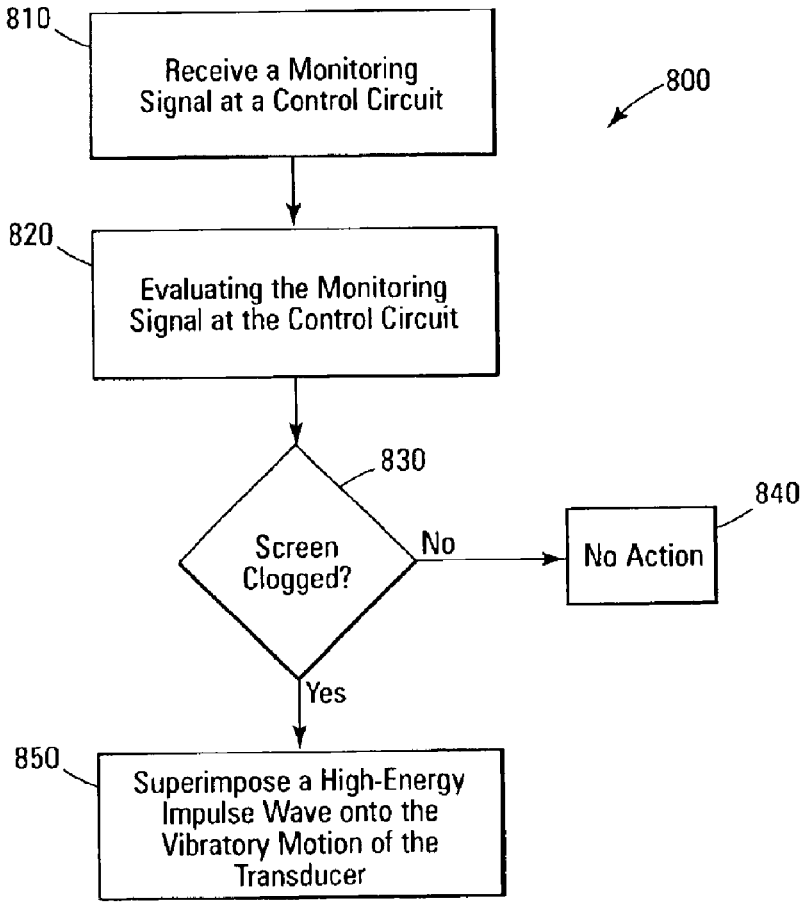
FIG. 8 is a flow chart of a method for unclogging a screen.

In another embodiment, apparatus 700 is used to unclog screen 102 using method 800, exemplified by the flow chart in FIG. 8. In the screening industry, screen clogging is termed "screen blinding." Block 810 of method 800 includes receiving the monitoring signal from the sensor portion of transducer 104 at control circuit 708, where the monitoring signal is indicative of the load on the screen. Block 820 includes evaluating the monitoring signal at the control circuit. The evaluation involves comparing the monitoring signal to a predetermined value indicative of a clogged screen. If the monitoring signal indicates that the load is below the predetermined value, the screen is unclogged, and method 800 proceeds along the "No" path from block 830 to block 840, where no action is taken. On the other hand, if the monitoring signal indicates that the load is above the predetermined value, the screen is clogged, and method 800 proceeds along the "Yes" path from block 830 to block 850.

Figure 9:
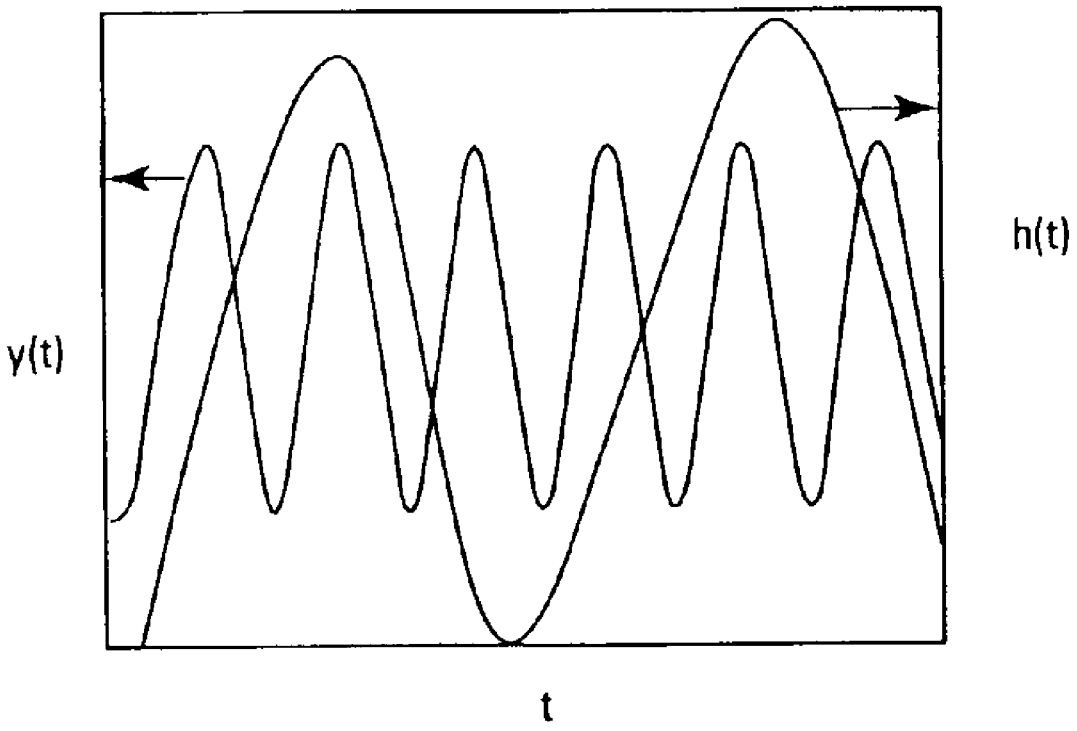
FIG. 9 is an example of superimposed waveforms that are transmitted to a transducer during a method for unclogging a screen.

Block 850 includes control circuit 708 transmitting a control signal to signal-generator/amplifier 706. The control signal causes signal-generator/amplifier 706 to superimpose a high-energy impulsive wave onto the vibratory motion of the transducer portion of transducer 104. This is exemplified for one embodiment in FIG. 9. In this embodiment, y(t) represents the vibratory motion and h(t) represents the high-energy impulsive wave. In this example, h(t) has a lower frequency and higher amplitude than y(t). The high-energy impulsive wave causes the transducer portion to impart high-energy impulses to screen 102. The high-energy impulses thus imparted shake the clogs loose from screen 102, thus unclogging it.

CONCLUSION

Embodiments of the present invention have been described. In one embodiment, a screening machine has been described that can be used to replace loud, bulky screening machines that use unbalanced motors. The present machine uses electrically controlled transducers to vibrate a separating screen. The transducers can be piezoelectric patches, discrete piezoelectric components, or electromagnetic shakers. Further, the transducers can be coupled directly to the screen or through a vibration amplifier. Different attachment locations have been described for coupling the transducers and/or amplifiers to the screen. In one embodiment, one or more of the transducers are used as sensors to provide feedback for operation control.

Although specific embodiments have been illustrated and described in this specification, it will be appreciated by those of ordinary skill in the art that any arrangement that is calculated to achieve the same purpose may be substituted for the specific embodiment shown. This application is intended to cover any adaptations or variations of the present invention. For example, the screen can have a variety of different shapes, e.g., circular, square, oval, or the like.

What is claimed is:

1. A screening machine, comprising:

a frame;

a mesh enclosed within and attached to the frame;

a motion amplifier substantially rigidly attached in direct contact with the frame and not in direct contact with the mesh; and a transducer substantially rigidly attached to the motion amplifier to impart a vibratory motion to the motion amplifier, wherein the motion amplifier amplifies the vibratory motion and imparts the amplified vibratory motion directly to the frame and thereby to the mesh.

2. The screening machine of claim 1, wherein the motion amplifier is C-shaped and includes two ends, wherein one end is attached to the frame and the other end is attached to the transducer.

3. The screening machine of claim 1, wherein the motion amplifier is S-shaped and includes two ends, wherein one end is attached to the frame and the other end is attached to the transducer.

4. The screening machine of claim 1, wherein the motion amplifier is a plurality of C-shaped motion amplifiers linked together and includes two ends, wherein one end is attached to the frame and the other end is attached to the transducer.

5. The screening machine of claim 1, wherein the motion amplifier is a straight beam that is pinned at both of its ends, wherein the transducer is attached to the beam between the two ends and the frame is attached to the beam at a location between the two ends.

6. The screening machine of claim 1, wherein the motion amplifier is at least two straight beams, each beam being pinned at both of its ends, the beams being substantially rigidly coupled by a coupler attached to each of the beams between the ends of the respective beams, wherein the transducer is attached to at least one of the beams between the two ends and the frame is attached to one of the beams between the two ends.

7. The screening machine of claim 1, wherein a portion of the transducer is used to sense the vibration of the screen.

8. The screening machine of claim 1, further comprising a power supply having an output that is electrically coupled to the transducer.

9. The screening machine of claim 8, further comprising a control circuit having an input coupled to a sensing output of the transducer and an output coupled to an input of the power supply.

10. The screening machine of claim 1, further comprising a control circuit having an input coupled to a sensing output of the transducer and further comprising a signal-generator/amplifier having an input coupled to an output of the control circuit and having an output coupled to the transducer.

11. The screening machine of claim 1, wherein the transducer comprises an electromagnetic shaker.

12. A screening machine, comprising:

a frame;

a mesh enclosed within and attached to the frame;

a motion amplifier substantially rigidly attached in direct contact with the frame and not in direct contact with the mesh;

a transducer substantially rigidly attached in direct contact with the motion amplifier to impart a vibratory motion to the motion amplifier, wherein the motion amplifier amplifies the vibratory motion and imparts the amplified vibratory motion directly to the frame and thereby to the mesh; and a sensor substantially rigidly attached in direct contact with the motion amplifier.

13. The screening machine of claim 12, wherein the transducer and the sensor sandwich the motion amplifier therebetween.

14. A screening machine, comprising:

a frame;

a mesh enclosed within and attached to the frame;

a motion amplifier substantially rigidly attached in direct contact with the frame and not in direct contact with the mesh;

a transducer substantially rigidly attached in direct contact with the motion amplifier to impart a vibratory motion to the motion amplifier, wherein the motion amplifier amplifies the vibratory motion and imparts the amplified vibratory motion directly to the frame and thereby to the mesh;

a sensor substantially rigidly attached in direct contact with the motion amplifier; and a control circuit having an input coupled to the sensor and an output coupled to the transducer.

15. The screening machine of claim 14, further comprising a power supply coupled between the output of the control circuit and the transducer.

16. The screening machine of claim 14, further comprising a signal generator/amplifier coupled between the output of the control circuit and the transducer.

17. A screening machine, comprising:

a frame, wherein the frame is substantially a parallelogram with four corners;

a mesh enclosed within and attached to the frame;

a motion amplifier substantially rigidly attached in direct contact with the frame and not in direct contact with the mesh, the motion amplifier extending from at least one of the four corners; and a transducer substantially rigidly attached in direct contact with the motion amplifier to impart a vibratory motion to the motion amplifier, wherein the motion amplifier amplifies the vibratory motion and imparts the amplified vibratory motion directly to the frame and thereby to the mesh.

18. The screening machine of claim 17, further comprising a sensor substantially rigidly attached in direct contact with the motion amplifier.

19. The screening machine of claim 18, wherein the transducer and sensor sandwich the motion amplifier therebetween.

20. A screening machine, comprising:

a frame, wherein the frame is substantially a parallelogram with four corners;

a mesh enclosed within and attached to the frame;

a first motion amplifier substantially rigidly attached in direct contact with the frame and not in direct contact with the mesh, the first motion amplifier extending from at least one of the four corners;

a first transducer substantially rigidly attached in direct contact with the first motion amplifier to impart a first vibratory motion to the first motion amplifier, wherein the first motion amplifier amplifies the first vibratory motion and imparts the amplified first vibratory motion directly to the frame and thereby to the mesh;

a second motion amplifier substantially rigidly attached in direct contact with the frame between two of the four corners; and a second transducer substantially rigidly attached in direct contact with the second motion amplifier to impart a second vibratory motion to the second motion amplifier, wherein the second motion amplifier amplifies the second vibratory motion and imparts the amplified second vibratory motion directly to the frame and thereby to the mesh.

21. The screening machine of claim 20, further comprising a sensor substantially rigidly attached in direct contact with at least one of the first and second motion amplifiers.

22. The screening machine of claim 21, wherein the transducer and sensor sandwich at least one of the first and second motion amplifiers therebetween.

23. A screening method comprising:

transmitting an alternating voltage from a signal-generator/amplifier to a transducer, wherein the alternating voltage causes the transducer to produce a vibratory output;

amplifying the vibratory output of the transducer by substantially rigidly attaching the transducer to a motion amplifier;

vibrating a screen by imparting the amplified vibratory output to the screen by substantially rigidly attaching the motion amplifier in direct contact with a frame of the screen and not in direct contact with a mesh enclosed within the frame;

using a portion of the transducer as a sensor;

transmitting a monitoring signal from the sensor to a control circuit that is indicative of at least one of the amplitude and frequency of the vibration imparted to the screen;

transmitting a control signal from the control circuit to the signal-generator/amplifier; and using the control signal to adjust at least one of the amplitude and frequency of the alternating voltage transmitted to the transducer and thereby at least one of the amplitude and frequency of the vibration of the screen.

* * * * *